United States Patent [19]

Shieh

[11] Patent Number: 5,066,238

[45] Date of Patent: Nov. 19, 1991

[54] ELECTRICAL SOCKET

[76] Inventor: Gray Shieh, Fl. 9-4, No. 106, Sec. 3, Hsin-I Rd., Taipei City, Taiwan

[21] Appl. No.: 706,297

[22] Filed: May 28, 1991

[51] Int. Cl.[5] ..... H01R 13/44

[52] U.S. Cl. ..... 439/139; 439/137

[58] Field of Search ..... 439/136–139, 439/143, 145

[56] References Cited

U.S. PATENT DOCUMENTS

| | | | |
|---|---|---|---|
| 2,532,219 | 11/1950 | Bierce | 439/139 |
| 2,752,581 | 6/1956 | Benander | 439/139 |
| 3,980,372 | 9/1976 | Ranzanizo | 439/139 |

FOREIGN PATENT DOCUMENTS

| | | | |
|---|---|---|---|
| 0021610 | 1/1981 | European Pat. Off. | 439/139 |
| 2109720 | 10/1971 | Fed. Rep. of Germany | 439/139 |
| 2545657 | 11/1984 | France | 439/139 |

*Primary Examiner*—Paula A. Bradley

*Attorney, Agent, or Firm*—Ratner & Prestia

[57] ABSTRACT

An electrical socket includes a socket housing which receives conductor pieces that are adapted to be electrically connectable to contact blades of an electrical plug. A rotary plate of a socket cover is provided in the front face of the socket housing. The socket cover further has a shaft projecting rearward from the rotary plate and extending into the socket housing. The socket cover is movable between a closed position, wherein the rotary plate blocks entry into the socket housing, and an open position, wherein entry into the socket housing is permissible, allowing plugging of the electrical plug into the electrical socket to achieve electrical connection between the contact blades and the conductor pieces. A control member engages the rotary plate when the socket cover is in the closed position to prevent rotation of the rotary plate relative to the socket housing. The control member can, however, be pushed inward to disengage it from the rotary plate, permitting rotation of the rotary plate from the closed position to the open position. A torsion spring is provided in the socket housing and is connected to the shaft and to the socket housing. The torsion spring returns the socket cover to the closed position when the electrical plug is pulled out of the electrical socket.

5 Claims, 4 Drawing Sheets

ELECTRICAL SOCKET

BACKGROUND OF THE INVENTION

1. Field of the Invention

The invention relates to an electrical socket, more particularly to an electrical socket having a protective cover to cover the socket openings thereof when the electrical socket is not in use.

2. Description of the Related Art

Presently, as the number of electrical appliances acquired by a household grows, the need for numerous electrical sockets which can be conveniently accessed becomes an important factor in housing design.

One of the disadvantages of conventional electrical socket constructions is that they are not provided with a cover structure which can cover the socket openings thereof when the electrical socket is not in use. Since the electrical sockets are within reach of children, and since most children would frequently notice their elders plugging and unplugging electrical appliances from the electrical sockets, they would eventually become curious and might decide to play with them, unknowing of the dangers of doing so. Accidental fire or electrical shock may occur if a child unknowingly inserts a conductive object (such as a clip or a key) into the electrical socket.

SUMMARY OF THE INVENTION

The main objective of the present invention is to provide an electrical socket having a protective cover that automatically covers the socket openings thereof when the electrical socket is not in use.

Accordingly, the preferred embodiment of an electrical socket of the present invention comprises: a socket housing defining conductor receiving spaces therein and having a front face provided with a circular depression, spaced socket openings provided in the circular depression and serving as passages into the conductor receiving spaces, a shaft opening provided at the center of the circular depression, and a control piece opening similarly disposed in the circular depression; conductor pieces provided inside the conductor receiving spaces and adapted to be electrically connectable to contact blades of an electrical plug; a socket cover including a circular rotary plate provided in the circular depression and having a number of openings, and a shaft projecting rearward from the rotary plate and extending through the shaft opening, the socket cover being movable between a closed position, wherein the rotary plate covers the socket openings, and an open position, wherein the openings of the rotary plate are aligned with the socket openings, permitting insertion of the contact blades of the electrical plug into the electrical socket to achieve electrical connection between the contact blades and the conductor pieces; a control member including a control piece provided in the control piece opening and a spring to urge the control piece to engage one of the openings in the rotary plate when the socket cover is in the closed position, engagement of the control piece with one of the openings of the rotary plate preventing rotation of the rotary plate relative to the socket housing, the control piece being disengageable from the rotary plate to permit rotation of the rotary plate from the closed position to the open position; and a torsion spring means provided in the socket housing and being connected to the shaft and the socket housing, the torsion spring means returning the socket cover to the closed position when the electrical plug is pulled out of the electrical socket.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
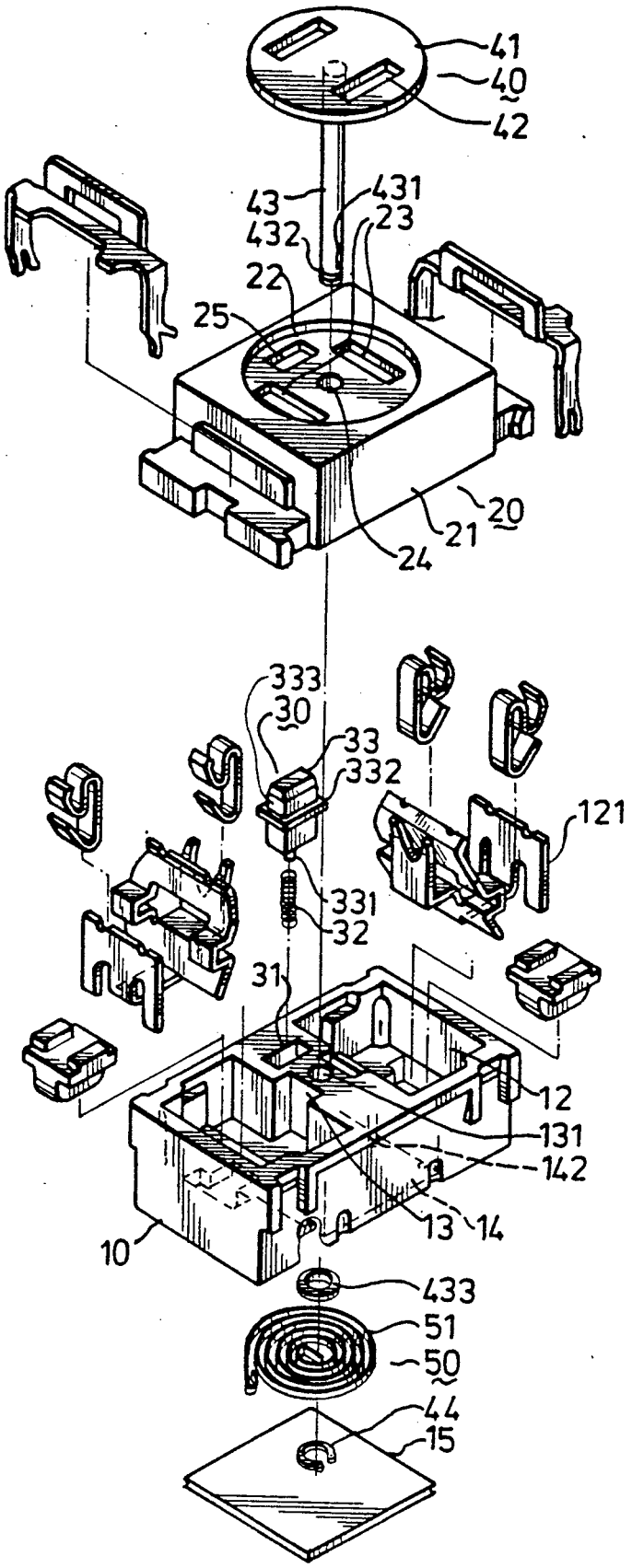
FIG. 1 is an exploded view of the first preferred embodiment of an electrical socket according to the present invention.
Figure 2:
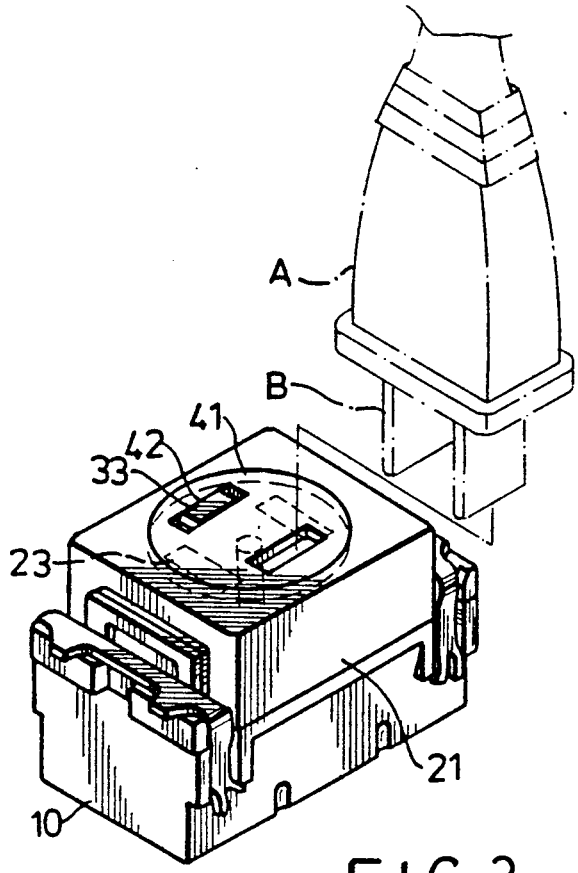
FIG. 2 is a perspective view of the assembled first preferred embodiment.

Referring to FIGS. 1 and 2, the first preferred embodiment of an electrical socket according to the present invention is shown to comprise a socket housing including a housing frame 10 and a housing cover 20, conductor pieces 121, a control member 30, a socket cover 40, and a torsion spring means 50.

The housing frame 10 defines two conductor receiving spaces 12 therein to receive the conductor pieces 121. The conductor pieces 121 are adapted to clamp the contact blades (B) of an electrical plug (A) to achieve electrical connection. The construction of the conductor pieces 121 is known in the art and will not be detailed further. The housing frame 10 has a partition 13 separating the conductor receiving spaces 12, and a shaft opening 131 provided in the partition 13. The rear face of the housing frame 10 has a depression 14. A base plate 15 is mounted on the rear face of the housing frame 10 to cover the depression 14.

The housing cover 20 is mounted on the front end of the housing frame 10 and includes a cover frame 21 having a front face provided with a circular depression 22. The cover frame 21 has a pair of spaced socket openings 23 provided in the circular depression 22 and serving as passages into the conductor receiving spaces 12, a shaft opening 24 provided at the center of the circular depression 22 and to be aligned with the shaft opening 131 of the housing frame 10, and a control piece opening 25 similarly provided in the circular depression 22.

The control member 30 is provided in a receiving space 31 on the partition 13 and includes a spring 32 and a control piece 33. The rear end of the control piece 33 is provided with a connector 331 to engage the spring 32. The control piece 33 has a peripheral flange 332 and an front end portion 333 with a chamfered periphery. The spring 32 urges the control piece 33 to extend through the control piece opening 25. The peripheral flange 332 prevents the control piece 33 from fully extending through the control piece opening 25 and, at the same time, prevents the front end portion 333 of the control piece 33 from entering the receiving space 31.

The socket cover 40 includes a circular rotary plate 41 disposed on the circular depression 22 to selectively cover the socket openings 23 of the housing cover 20, and a shaft 43 extending rearward from the center of the rotary plate 41 and through the shaft openings, 24 and 131. The rotary plate 41 has a pair of openings 42 to selectively access the socket openings 23. The shaft 43 is provided with a transverse through hole 431 and an annular groove 432 disposed adjacent to the rearmost end of the shaft 43. The rearmost end of the shaft 43 extends into the depression 14. A C-shaped ring 44 engages the shaft 43 at the annular groove 432 to keep the rearmost end of the shaft 43 in the depression 14. A packing ring 433 is sleeved on the shaft 43 adjacent to the rearmost end of the same.

The torsion spring means 50 is disposed inside the depression 14 and includes a coiled torsion spring 51. The innermost turn of the torsion spring 51 engages the shaft 43 at the transverse through hole 431. The outermost turn of the torsion spring 51 is attached to a protrusion 142 projecting from the housing frame 10 and extending into the depression 14.

When the socket cover 40 is in the closed position, the control piece 33 extends into one of the openings 42 of the rotary plate 41. The socket openings 23 are not aligned with the openings 42 and are covered by the rotary plate 41. Thus, the contact blades (B) of the electrical plug (A) cannot be connected to the conductor pieces 121. To electrically connect the contact blades (B) and the conductor pieces 121, the contact blades (B) are inserted in the openings 42 to push the control piece 33 against the action of the spring 32, and disengage the control piece 33 from the rotary plate 41, thereby permitting rotation of the rotary plate 41. The rotary plate 41 is then rotated until the openings 42 are aligned with the socket openings 23 of the housing cover 20. The contact blades (B) can then be fully inserted in the socket openings 23 to achieve electrical connection with the conductor pieces 121.

The torsion spring 51 is wound when the rotary plate 41 is rotated from the closed position to the open position. When the electrical plug (A) is pulled out, the torsion spring 51 provides the necessary returning force to rotate the rotary plate 41 back to the closed position.

Figure 3:
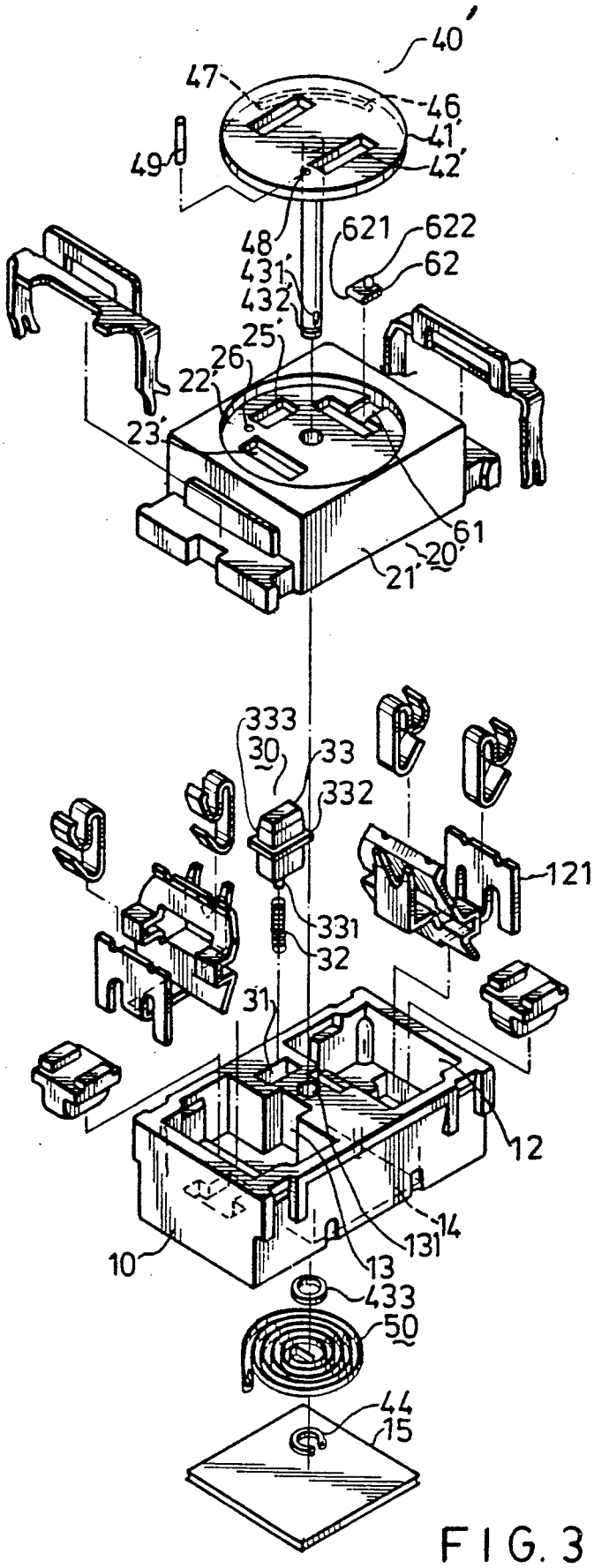
FIG. 3 is an exploded view of the second preferred embodiment of an electrical socket according to the present invention.

Referring to FIG. 3, the second preferred embodiment of an electrical socket according to the present invention is shown to be substantially similar to the first preferred embodiment. The housing cover 20' of the second preferred embodiment, however, has a slide recess 61 provided in the circular depression 22'. The slide recess 61 is perpendicular to and extends radially outward from one of the socket openings 23'. A slide piece 62 is movably provided in the slide recess 61. The slide piece 62 has a curved front end 621 and a frontwardly extending stub 622. The rear face of the rotary plate 41' is provided with a circumferentially extending sectoral groove 46 and a slot 47 extending outwardly from one end of the sectoral groove 46. The rotary plate 41' is further provided with a pin hole 48 to be selectively aligned with a pin bore 26 formed in the circular depression 22' of the housing cover 20'. A locking pin 49 is received in the pin bore 26 and the pin hole 48 to lock rotary plate 41' in the open position, if it is not desired to cover the socket openings 23'.

Figure 4:
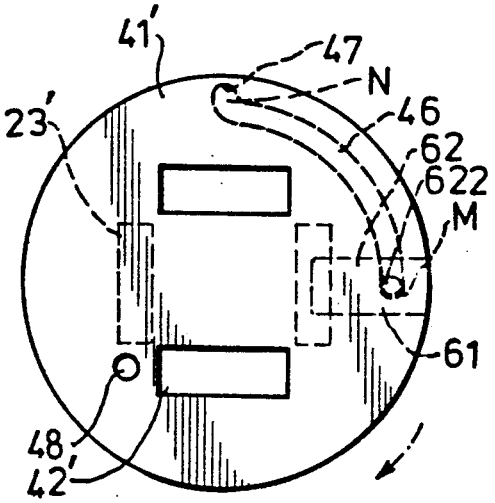
FIG. 4 is an illustration of the second preferred embodiment when in a closed position.

FIG. 4 is a top view of the second preferred embodiment when in a closed position. To uncover the socket openings 23', the contact blades of the electrical plug are inserted in the openings 42' and are rotated to move the rotary plate 41' until the openings 42' are aligned with the socket openings 23'. Since the stub 622 of the slide piece 62 extends into the sectoral groove 46 of the rotary plate 41', rotation of the rotary plate 41' from the closed position to the open position thus causes the position of the stub 622 to be changed from one end (M) of the sectoral groove 46 to the other end (N) of the same.

Figure 5:
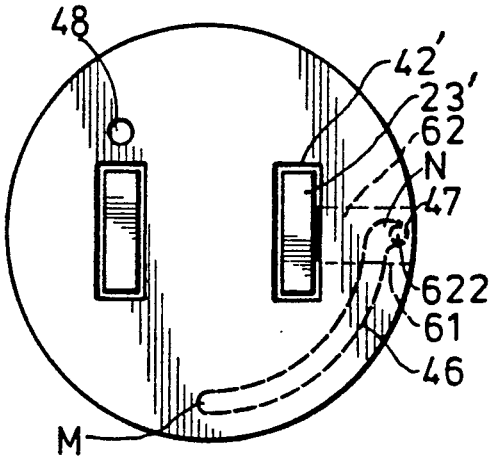
FIG. 5 is an illustration of the second preferred embodiment when in an open position.

Referring to FIG. 5, as the contact blades of the electrical plug are inserted into the socket openings 23', one of the contact blades pushes the slide piece 62 outward so that the stub 622 extends into the slot 47. When the electrical plug is pulled out, the torsion spring 51 unwinds to disengage the stub 622 from the slot 47 and return the slide piece 62 to its former position. The torsion spring 51 then moves the rotary plate 41' to its former closed position.

The slide piece 62 and the sectoral groove 46 permit accurate alignment of the openings 42' and the socket openings 23'. When the slide piece 62 engages the slot 47, torsion applied by the torsion spring 51 on the contact blades is reduced, thereby making it easier to extract the electrical plug.

Figure 6:
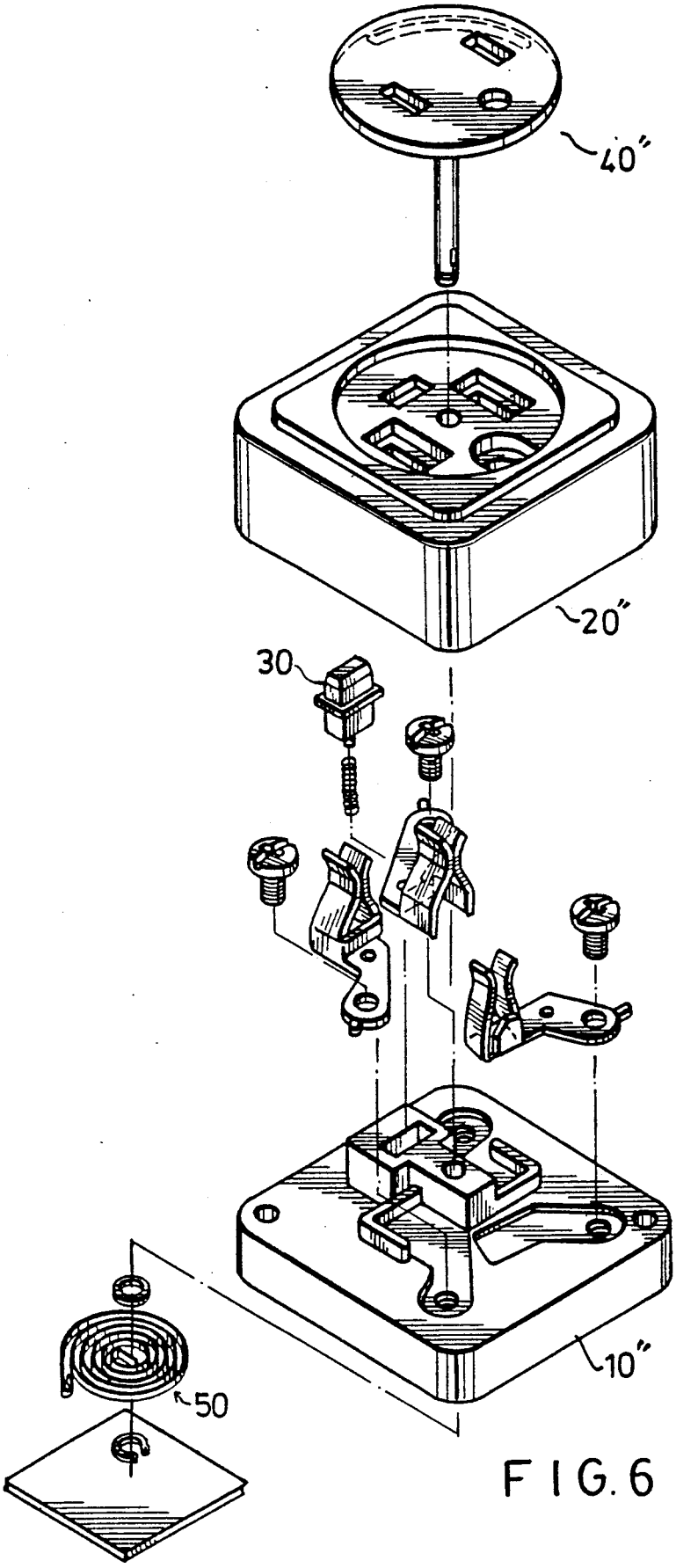
FIG. 6 is an exploded view of the third preferred embodiment of an electrical socket according to the present invention.

Referring to FIG. 6, the third preferred embodiment of an electrical socket according to the present invention is shown to similarly comprise a housing frame 10'', a housing cover 20'', a control member 30, a socket cover 40'', and a torsion spring means 50. The construction and operation of the third preferred embodiment is substantially similar to the first preferred embodiment except that the third preferred embodiment has three socket openings to receive three contact blades, one of which is to be electrically grounded.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. An electrical socket to receive an electrical plug having a number of contact blades, comprising:

a socket housing defining a plurality of conductor receiving spaces therein and having a front face provided with a plurality of spaced socket openings each serving as a passage into one of said conductor receiving spaces, a shaft opening disposed between said socket openings, and a control piece opening;

a conductor piece provided inside each of said conductor receiving spaces and adapted to be electrically connectable to one of said contact blades;

a socket cover including a rotary plate provided in said front face of said socket housing and having a plurality of openings, and a shaft projecting rearward from said rotary plate and extending through said shaft opening, said socket cover being movable between a closed position, wherein said rotary plate covers said socket openings, and an open position, wherein each of said openings of said rotary plate is aligned with one of said socket openings, to permit insertion of said contact blades of said electrical plug into said conductor receiving spaces;

a control member including a control piece provided in said control piece opening and a spring to urge said control piece to engage one of said openings in said rotary plate when said socket cover is in said closed position, engagement of said control piece with one of said openings of said rotary plate preventing rotation of said rotary plate relative to said socket housing, said control piece being disengageable from said rotary plate to permit rotation of said rotary plate from said closed position to said open position; and a torsion spring means provided in said socket housing and being connected to said shaft and said socket housing, said torsion spring means returning said socket cover to said closed position when said contact blades of said electrical plug are pulled out of said electrical socket.

2. The electrical socket as claimed in claim 1, wherein said socket housing has a rear face provided with a depression, said socket housing further including a base plate mounted on said rear face to cover said depression, said shaft extending into said depression, said torsion spring means being provided in said depression.

3. The electrical socket as claimed in claim 1, wherein said front face of said socket housing is provided with a circular depression; said socket openings, said shaft opening and said control piece opening being disposed in said circular depression.

4. The electrical socket as claimed in claim 3, wherein said shaft opening is provided at the center of said circular depression, and said rotary plate is a circular plate provided on said circular depression.

5. The electrical socket as claimed in claim 4, wherein:

said socket housing has a slide recess perpendicular to and extending radially outward from one of said socket openings;

said rotary plate has a rear face provided with a circumferentially extending sectoral groove and a slot extending outward from one end of said sectoral groove;

said electrical socket further comprises a slide piece movably provided in said slide recess and having a stub extending into said sectoral groove;

whereby, when said socket cover is in said open position and said contact blades of said electrical plug are inserted into said electrical socket, one of said contact blades pushes said slide piece outward to engage said stub with said slot so as to reduce torsion applied by said torsion spring means to said contact blades.

* * * * *

UNITED STATES PATENT AND TRADEMARK OFFICE

CERTIFICATE OF CORRECTION

PATENT NO. : 5,066,238

DATED : November 19, 1991

INVENTOR(S) : Gary Shieh

It is certified that error appears in the above-identified patent and that said Letters Patent is hereby corrected as shown below:

Title page, item [76] Inventor: change "Gray" to --Gary--.

Signed and Sealed this

Seventeenth Day of May, 1994

*Attest:*

Bruce Lehman

BRUCE LEHMAN

*Attesting Officer*

*Commissioner of Patents and Trademarks*